US006803078B2

(12) United States Patent
Haug et al.

(10) Patent No.: US 6,803,078 B2
(45) Date of Patent: Oct. 12, 2004

(54) PROCESS FOR PRODUCING A SURFACE LAYER

(75) Inventors: Tilman Haug, Weissenhorn (DE); Patrick Izquierdo, Ulm (DE); Michael Scheydecker, Nersingen (DE); Oliver Storz, Blaustein (DE); Tanja Tschirge, Goeppingen (DE); Karl-Ludwig Weisskopf, Rudersberg (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/912,451

(22) Filed: Jul. 26, 2001

(65) Prior Publication Data

US 2002/0034593 A1 Mar. 21, 2002

(51) Int. Cl.[7] ..... B05D 1/08

(52) U.S. Cl. ..... 427/449; 427/190; 427/191; 427/192; 427/201; 427/314; 427/376.3; 427/376.6; 427/383.1; 427/421; 427/422; 427/427; 427/429; 427/446; 427/453; 427/455; 427/456; 427/554; 427/557; 427/561; 427/569; 427/591; 427/595; 427/597

(58) Field of Search ..... 427/561, 569, 427/591, 557, 554, 446, 453, 455, 456, 596, 597, 190, 191, 192, 201, 314, 376.3, 376.6, 383.1, 421, 422, 427, 429

(56) References Cited

U.S. PATENT DOCUMENTS 5,194,237 A * 3/1993 Cliché et al. ..... 423/440
6,025,065 A * 2/2000 Claussen et al. ..... 428/303.7
6,319,617 B1 * 11/2001 Jin et al. ..... 428/469
6,458,279 B1 * 10/2002 Duffield et al. ..... 210/687

FOREIGN PATENT DOCUMENTS

| | | | |
|---|---|---|---|
| DE | 4102495 | of 1992 | |
| DE | 19605858 | of 1997 | |
| DE | 19750599 | of 1998 | |
| EP | 0496935 | of 1981 | |
| EP | 0522583 B1 | 8/1995 | ..... F16J/15/34 |
| EP | 0482831 B1 | 1/1996 | ..... C23C/4/06 |

OTHER PUBLICATIONS

Communication from the German Patent Office dated Oct. 20, 2003.

* cited by examiner

*Primary Examiner*—Bernard Pianalto
(74) *Attorney, Agent, or Firm*—Crowell & Moring LLP

(57) ABSTRACT

The invention relates to a process for producing a surface layer with embedded inter-metallic phases, which is distinguished by the fact that a layer comprising a metal and a ceramic is applied to a substrate element, that a reaction takes place between the metal and the ceramic of the layer as a result of energy being introduced during the application of the layer or as a result of a subsequent introduction of energy, and as a result the surface layer is produced, with inter-metallic phases being formed.

8 Claims, No Drawings

PROCESS FOR PRODUCING A SURFACE LAYER

CROSS-REFERENCE TO RELATED APPLICATIONS

This application is related to pending U.S. patent application Ser. No. 09/912,418 filed on Jul. 26, 2001, corresponding to and claiming the priority of German application 100 36 262.1.

BACKGROUND AND SUMMARY OF THE INVENTION

This application claims the priority of German application 100 36 264.8, filed Jul. 26, 2000, the disclosure of which is expressly incorporated by reference herein.

The invention relates to a process for producing a surface layer with embedded inter-metallic phases.

German Patent Document DE 197 50 599 A1 disclose a design element which comprises an $Al_2O_3$-containing surface layer with embedded high-temperature-resistant aluminides. To produce a design element of this type, a sintered, porous ceramic body is placed in a die-casting mold and is infiltrated with aluminium under pressure. During the infiltration, the ceramic body reacts with the aluminum, forming the above-mentioned aluminides. The design element generally only fills parts of the component, and consequently, the component consists partially of aluminum and partially, in particular at the component regions which are subject to frictional loads, of the said design element.

To produce the design element in accordance with DE 197 50 599 A1, it is necessary, in a complex way, to mold, sinter and machine a ceramic body before it is infiltrated with aluminium during the die-casting. Furthermore, there is a distinct transition between the design element and the remaining component, which functions as a substrate element, which has an adverse affect on the adhesion between the said elements.

Accordingly, the invention is based on the object of providing a surface layer which is less expensive than that of the prior art and has a high degree of wear resistance.

The object is achieved by a process for producing a surface layer with embedded inter-metallic phases.

Other objects, advantages and novel features of the present invention will become apparent from the following detailed description of the invention.

DETAILED DESCRIPTION OF THE PREFERRED EMBODIMENT

In the invented process for producing a surface layer with embedded inter-metallic phases, a pulverulent mixture of a metal and a ceramic which can be chemically reduced by this metal is applied to the surface of a substrate element. A chemical redox reaction which proceeds in accordance with the following equation:

$$Me_KX+Me_S \rightarrow ME_KMe_S+Me_SX \qquad \text{Eq. 1}$$

(without taking account of coefficients of stoichiometry) is brought about by introduction of energy. In this equation, $Me_K$ represents a metal which is chemically bonded in the ceramic, X represents a non-metal selected from the group consisting of oxygen (O), carbon (C), boron (B) and/or nitrogen (N). The designation $Me_S$ represents the metal which is contained in elemental form (or as an alloy) in the applied layer. In accordance with Equation 1, the metal $Me_S$ reacts with the ceramic in such a way that it both forms an intermetallic compound with the metal $Me_K$ and, at the same time, takes its place in the ceramic, therefore replacing the latter, and thereby producing a new ceramic compound. The surface layer produced in this way has a particularly high level of wear resistance.

Aluminum is particularly expedient as metal Me. Aluminium reduces most ceramic compounds of the form indicated in Equation 1. Moreover, it forms high-temperature-resistant inter-metallic compounds which are particularly wear-resistant.

The ceramic of the layer preferably consists of an oxide ceramic. Oxide ceramics can be reduced well in particular by aluminium (Al), and in addition many oxide ceramic raw materials are particularly inexpensive. The metal $Me_K$ which is chemically bonded in the ceramic is preferably a transition metal or the semimetal silicon (Si), and titanium (Ti) or silicon are particularly preferably used. In this case, it is possible for the ceramic to contain a plurality of metals. Accordingly, examples of preferred ceramics are titanium dioxide ($TiO_2$), silicon dioxide ($SiO_2$) or mixed oxides, such as spinels, silicates or ilmenite.

The coating of the surface of the substrate element may be carried out using most conventional coating processes. These include physical and chemical deposition processes, such as sputtering, sol-gel processes, electrodeposition or CVD coating. Slip techniques, as are conventionally used in the production of ceramics, or painting techniques (e.g. dip painting or spraying) are particularly suitable and can be used to produce a particularly inexpensive layer. Furthermore, thermal spraying processes, such as flame spraying, high-speed flame spraying, plasma spraying, wire arc spraying or kinetic cold gas compacting, are expedient coating processes. The thermal spraying processes ensure a particularly dense layer and are also inexpensive to carry out.

Particularly with the abovementioned thermal spraying processes, energy which brings about the reaction between the substrate element and the ceramic layer can be introduced in situ. This takes place if the pulverulent mixture of the metal $Me_S$ and the ceramic is at a sufficient temperature to initiate a reaction when it comes into contact with the substrate material. With other coating processes, an additional heat treatment is introduced. The heat treatment may take place selectively, i.e. only those regions of the substrate element which are provided with the layer are heated. This is particularly expedient, since in this way the substrate element is not exposed to any additional load, for example from corrosion or microstructural change. Concentrated thermal radiation (e.g. from high-energy infrared lamps), laser irradiation or induction heating are particularly suitable for the selective heating.

It should be ensured that the softening temperature or the decomposition temperature of the substrate element lies above the reaction temperature. Therefore, iron-based metals, but also aluminium-based or nickel-based metals, are particularly suitable substrate elements. Moreover, the process according to the invention can be applied to inorganic, non-metallic substrate elements made from ceramic or glass. Particularly suitable substrate elements are components which are used in the drive train and running gear of a motor vehicle and are exposed to high frictional loads. These include, inter alia, cylinder crankcases, cylinder heads, pistons, transmission casings and synchronizer rings.

The invented process is explained in more detail in the examples which follow.

EXAMPLE 1

Cylinder liners of a cylinder crankcase consisting of the alloy AlSi9Cu3 are coated with a mixture of aluminium and titanium oxide powder using the plasma spraying process. The powder particles have diameters of between 10 μm and 50 μm. The particles are heated to approx. 1800° C. in the plasma gas (argon/hydrogen), in the process melt at least partially and, in the softened state, come into contact with the surface of the cylinder liner. The resulting layer thickness is approx. 200 μm.

The powder mixture which has been heated by the plasma in principle reacts in accordance with the reaction given in Equation 2:

$$Al+TiO_2 \rightarrow Al_xTi_y+Al_2O_3 \qquad \text{Eq. 3}$$

(The equation is given without regard to coefficients of stoichiometry.)

The reaction given in Equation 1 takes place during the heating of the powder in the plasma gas. This is an in situ reaction during application of the layer. The inter-metallic compounds $Al_xTi_y$ which are formed during this reaction may have different stoichiometric compositions x and y depending on the composition of the powder mixture and as a function of the spraying parameters. The functional properties of the layer can be influenced by the stoichiometric composition of the intermetallic compounds. A high aluminium content leads to a better resistance to oxidation, whereas a high titanium content leads to improved ductility and a higher melting point of the layer.

EXAMPLE 2

A suspension of a pulverulent mixture of aluminium (alloy AlSi12) and titanium oxide is applied to the cylinder liner of a cylinder crankcase (alloy AlSi9Cu3) with the aid of a spray gun as used for painting. During a drying process, the solvent evaporates, and the resulting layer thickness is approx. 250μm.

In a further process step, energy is introduced by means of an infrared heat radiator, this introduction of energy being set in such a way that a temperature of approx. 560° C. is produced in the layer. This temperature leads to a reaction as outlined by Equation 2. Furthermore, a reaction in accordance with Equation 2 also takes place at the interface between the layer and the substrate element, resulting in good adhesion between the surface layer and the substrate element.

During the introduction of energy, the temperature in the layer can be controlled by means of the amount of energy introduced. The reaction sequence can be controlled by the reaction temperature and the duration of heating. For example, in this way it is possible to stop the reaction before complete conversion has taken place. There remains a residual quantity of aluminium in the layer in this instance, which is of benefit to the ductility of the layer. Therefore, the heating parameters can be used to have a controlled influence on the functional properties of the surface layer.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method of producing a surface layer on a carrier element permeated with intermetallic phases, comprising the steps:

applying metal particles and ceramic particles to a surface of the carrier element by one of a plasma spray method, an electric arc wire spraying method and a kinetic cold gas compacting method, introducing energy during the applying step whereby a reaction takes place between the metal particles and the ceramic particles to form intermetallic phases resulting in the production of the surface layer.

2. The method according to claim 1, wherein the energy is introduced via at least one of an infrared heating source, a laser, and an induction heat source.

3. The method according to claim 1, wherein the metal particles of the layer are aluminum or an aluminum alloy.

4. The method according to claim 3, wherein the ceramic particles of the layer are an oxidic ceramic.

5. The method according to claim 4, wherein the energy is introduced via at least one of an infrared heating source, a laser, and an induction heat source.

6. The method according to claim 3, wherein the energy is introduced via at least one of an infrared heating source, a laser, and an induction heat source.

7. The method according to claim 1, wherein the ceramic particles of the layer are an oxidic ceramic.

8. The method according to claim 7, wherein the energy is introduced via at least one of an infrared heating source, a laser, and an induction heat source.

* * * * *